United States Patent [19]

Hansen

[11] Patent Number: 4,682,814

[45] Date of Patent: Jul. 28, 1987

[54] TILTING SEAT AND BACK CHAIR, PARTICULARLY TILTING DESK CHAIR

[75] Inventor: Eckard Hansen, Margrethen, Switzerland

[73] Assignee: Provenda Marketing AG, Herisau, Switzerland

[21] Appl. No.: 667,278

[22] Filed: Nov. 1, 1984

[51] Int. Cl.[4] ..... A47C 1/032

[52] U.S. Cl. ..... 297/300; 297/301; 297/316

[58] Field of Search ..... 297/300, 301, 316, 319, 297/320, 340, 343

[56] References Cited

U.S. PATENT DOCUMENTS

| | | | |
|---|---|---|---|
| 2,471,024 | 5/1949 | Cramer | 297/301 |
| 2,859,799 | 11/1958 | Moore | 297/301 |
| 3,913,975 | 10/1975 | Carter | 297/316 X |
| 3,989,297 | 11/1976 | Kerstholt | 297/300 |
| 4,143,910 | 3/1979 | Geffers et al. | 297/301 |
| 4,411,469 | 10/1983 | Drabert et al. | 297/300 |

FOREIGN PATENT DOCUMENTS

| | | | |
|---|---|---|---|
| 558309 | 12/1943 | Canada | 297/301 |
| 1099705 | 2/1961 | Fed. Rep. of Germany | 297/316 |
| 7724774 | of 1977 | Fed. Rep. of Germany . | |
| 7631908 | of 1978 | Fed. Rep. of Germany . | |
| 2757349 | 7/1979 | Fed. Rep. of Germany | 297/300 |
| 2843058 | 4/1980 | Fed. Rep. of Germany | 297/300 |
| 524982 | of 1972 | Switzerland . | |
| 529537 | of 1972 | Switzerland . | |
| 2125284 | 3/1984 | United Kingdom | 297/340 |

*Primary Examiner*—Kenneth J. Dorner
*Assistant Examiner*—Peter R. Brown
*Attorney, Agent, or Firm*—Frishauf, Holtz, Goodman & Woodward

[57] ABSTRACT

To simplify the construction of a tilting chair, typically a desk chair, in which the seat (2) and chair back (7) tilt together, the chair back (4) has an extension or attachment arm (5) extending from the lower region thereof to a zone adjacent or beneath the seat (2), and a pivot positioned at, or below the seat pivotably connects the attachment arm (5) to the seat, so that the pivotable attachment of chair back and seat is placed close to the hip joint of a user of the chair. The attachment arm has an extending portion (5') which is connected by a guide element, in the form of a double-link lever (10') or a guide slit (10) to the support structure (2), the guide means being connected to the attachment arm, for example by a cross bolt (9) which, preferably, also serves as one attachment pivot of a positioning and force spring (7), preferably a gas spring which is pivotably connected (8) at its other end to the support structure (1).

21 Claims, 2 Drawing Figures

TILTING SEAT AND BACK CHAIR, PARTICULARLY TILTING DESK CHAIR

Reference to related publication: Swiss Pat. No 529,537.

The present invention relates to a desk chair, and more particularly to an office-type desk chair, in which the chair seat and the chair back are tied together to tilt simultaneously, under control of the user of the chair, as desired, or to lock the chair seat and chair back in a predetermined position.

BACKGROUND

Various types of chairs, particularly desk chairs, chairs to be used with work tables, drafting tables, and the like, have a combination seat-and-back tilting mechanism which permits, simultaneously, tilting back of the seat and of the back of the chair up to a predetermined fixed position; or to lock the chair in a desired predetermined e.g. tilted position. Chairs in which the seat and back tilt together are also referred to as synchronous work chairs or synchronous desk chairs, since adjustment of the inclination of the back of the chair causes simultaneously a shift of the inclination of the seat or seat plate.

Synchronized desk chairs usually have a spring, such as a locking-type spring element. The spring may be a mechanical spring, or may be a gas spring, a hydraulic arrangement, similar to a dash-pot, or the like. When the spring unit is not locked, the operator can tilt the seat and back of the chair, that is, change the inclination of the respective seat and back elements in accordance with desired posture or the work to be carried out. Any particular tilt can be locked in position by locking the spring when a specific tilt has been achieved by the user. The user may, of course, also release the lock, for example to obtain a more comfortable position, and then, again, lock the spring to maintain the particular inclination which was desired.

To lock and provide a tilting force or, rather, a counter force to the weight of the user, requires a lever mechanism which, customarily, is arranged beneath the seat, or in the back thereof. This lever arrangement interconnects the seat plate, the carrier frame for the back, and the spring unit, including its locking mechanism. The lever arrangement is usually so designed that the inclination of the back of the chair and of the seat have predetermined relationships with respect to each other, which are not necessarily linear, or strictly proportional. Such lever arrangements are costly to make, and comparatively large, and it is not an easy matter to fit the mechanism beneath the seat plate without extending the apparatus for the mechanism substantially below the seat plate. Use of a plurality of links or joints between the individual adjustment levers has an additional disadvantage: If the seat back is tilted frequently, the joints between the links or levers will become loose due to wear at bearings. The wear at different bearings usually becomes additive and, in the long run, the mechanism no longer will be stiff but, since chattering or loose bearings will be within the overall mechanism, it is no longer possible to lock the chair in a single predetermined position; rather, the inclination will oscillate about a medium, and shifting of weight of the user, or shifting of the user's position, causes wobble of the seat plate and the seat back, frequently accompanied by noise, which is highly undesirable.

A desk chair is described in Swiss Pat. No. 429,537, in which both the seat plate as well as the back support, or back frame, have link levers extending beneath the seat plate, secured to the seat carrier. The seat plate is tilted in dependence on the tilt of the back support by a double link lever which connects the seat plate with the seat carrier at a link point which is spaced from the link position of the arm of the back of the chair or its back support frame. A gas spring is used to counterbalance the weight of the user upon tilting of the seat plate and, in one structure, provides force tot he seat plate, to the back support carrier, and to the double link lever and the other linkages in connection therewith. The gas spring can be locked, so that a predetermined inclination of the seat plate and the back support frame can be obtained. The gas spring is positioned practically perpendicularly with respect to the seat plate. The overall construction of the unit is comparatively simple; yet, a relatively large movement between the back of the chair and the back of the user results when the seat is tilted or shifted. As a consequence, a user wearing a shirt or a blouse will, by frictional engagement, have the shirt or blouse pulled out from trousers or skirts. This relative movement has been termed a "shirt take-off" effect. The main reason for the relatively large movement between the back of the chair and the back of the user is the position of the pivot axis of the support element for the back of the chair, which remained stationary, whereas the position of the hip joint of the user, which forms the pivot axis for the body of the user, together with the seat plate, moves upwardly and downwardly. Gas springs have a relatively flat spring characteristic. This introduces an additional disadvantage in the particular construction: If the user moves backwardly against the back support chair, compensation of the of the weight of the user by the gas spring itself is not effectively obtained.

It has already been proposed to overcome the problem of pullout of a shirt or blouse from trousers, slacks or skirts by connecting the back support of the chair to a cable which, in turn, is connected to a slider located on the chair base or beneath the chair seat, so that movement of the back towards the top or towards the bottom can be effected with movement of the seat. This is intended to eliminate relative movement between the back of the user and the back support of the chair. Such a structure is comparatively expensive and subject to malfunction, for example jamming of the cable, guide pulleys or the like.

THE INVENTION

It is an object to provide a tilting-type chair, for example a desk chair, which is simple, has few parts, and in which relative movement between the back of a chair, or the chair back support, and the back of the user is effectively prevented even though the seat is tilted from one terminal position to another.

Briefly, in accordance with the invention, the arrangement is so made that, upon change of tilt of the seat, the pivot point of the back support or back element of the chair remains effectively stationary with respect to the hip joint of the user. This is accomplished by connecting the support or the back for the chair back not on the seat carrier itself, but rather in a region which is in the vicinity of the hip joint of the user, so that, upon shifting of the seat or seat plate, relative movement between the back of the chair and the back of the user is effectively avoided. A pivot is positioned laterally of, or just below the seat or seat plate, connected, for example, to a connecting arm which extends from the back. The connecting arm, additionally, and by an extension spaced from the pivot joint, is connected to the holding spring, which may, for example, be a gas spring, and additionally to a movable guide structure which may, for example, be a double-jointed link, or a guide track engaging the arm and the base support, for example a post or a guide plate secured to the post.

The structure, thus, by linking of the back of the chair to the seat thereof in the immediate vicinity of the hip joint of the user, thereby improves the comfort of the chair while avoiding the shirt or blouse take-off effect. Simultaneously, with a minimum of structural parts—a single double-pivoted link, or a simple guide track—simultaneous inclination of the chair back upon tilting of the seat is obtained—as is customary in synchronous tilt chairs.

The guide track—if used—can readily be constructed by a slit in the seat support, engaged by a cross bolt secured to the support frame for the chair back. This results in a particularly simple and reliable construction. The force application means, typically the gas spring, or a mechanical spring, and its locking arrangement, can be secured to the same cross bolt. Gas springs are particularly effective, inexpensive, and readily accomplish the double function of supplying, on the one hand, a resilient biassing force while, on the other, easily permitting locking the chair in a predetermined position by closing off a valve.

In accordance with a feature of the invention, the lockable spring element, preferably a gas spring, is pivotably connected to the chair back or an arm or frame structure portion thereof with one end of the spring. The other end is pivotably connected to the seat support or seat support structure. The pivot connection of the spring unit which, usually, is an elongated element, is so arranged that the spring path of the spring unit, in relation to the tilting backward movement of the chair back increases progressively as the chair back is tilted backwardly. This has the advantage that the spring force increases as the user applies more force towards the back, and, thus, a rearwardly leaning or tilting force is couteracted by a corresponding increasing counter spring force.

The double-pivot lever and the spring unit preferably have a common pivot axis or a common pivot point. In accordance with a preferred feature of the invention, if a double-pivot lever is used, the pivot points of the spring element and of the double-pivot lever are in one line or, if the spring unit is located offset with respect to the lever, in lines passing through a common plane. The arrangement is constructed, in a simple and easy manner, by utilizing a cross rod or cross bar extending transversely across the chair to form one common pivot shaft for two links on either side of the chair, or to connect the frame structure of the chair back on the sides of the chair while also connecting the link thereto; and to utilize a common pivot point which, also, may be a transversely extending rod as a common connecting element with the other pivot point of the double-pivot lever and the spring. The arrangement thus, provides for progressive increase in the spring path of the spring unit as the chair back is tilted rearwardly, thereby increasing the counteracting spring force, by simple and reliable structural elements which are readily constructed for low wear through the expected lifetime of the chair, thereby avoiding looseness or chatter of engaging elements during use of the chair.

Drawings

FIG. 1 is a schematic side view of the chair, in which the movable guide element is a double-pivot lever, showing the chair in two terminal positions, in an upright position in full line and in a reclining or tilted position in chain-dotted lines; and FIG. 2 is a view similar to FIG. 1 in which, however, the movable guide means is a guide track, likewise showing the chair in its two terminal positions.

DETAILED DESCRIPTION

Figure 1:
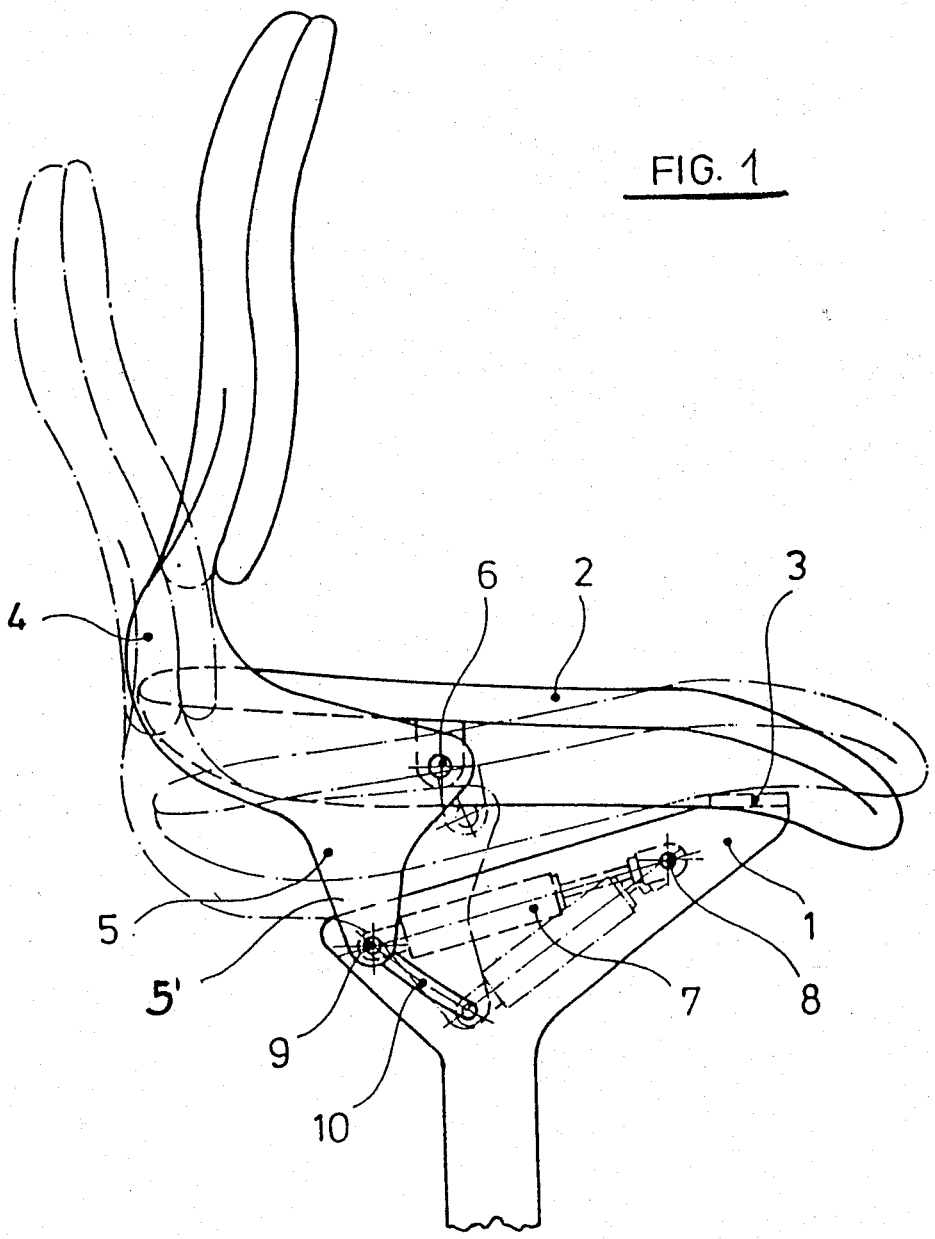

The chair—see FIG. 1—has a support 1 which, for example, is secured by means of a post to a bottom spider, a base plate or the like (not shown), in accordance with well known chair construction. The height of the support 1 above a base surface, preferably, is adjustable.

The seat plate 2 is movably connected to the support 1, typically, and as shown, by an elastic connecting plate 3. Other connections may be used. The connection plate 3 forms a forward or front pivot point. The connecting plate 3, which is resilient and for example of a rubbery-type or plastic material, may also be replaced by a connecting pin at either side of the chair seat, and connected to spaced projections on the support 1.

The chair seat, generally shown at 2, is connected to a chair back 4. The chair back 4, or its frame structure, has a projecting arm 5 which is linked close to the rear portion of the chair seat 2 at a pivot 6 to the chair seat. As can readily be seen, the pivot 6 is located close to the hip joint of a user. As shown, the pivot 6 is positioned beneath the chair seat, that is, below the top surface thereof. It is, of course, equally possible to provide a laterally projecting flange or similar structure extending from the frame of the seat 2 and placing the pivot axis of pivot 6 somewhat higher, that is, close to the upper surface of the seat 2, or even thereabove. For structural and esthetic reasons, however, the construction shown in FIG. 1, in which the pivot axis 6 is just beneath the seating surface of the seat 2, is preferred. Regardless of how positioned, the pivot axis 6 is either at the level of the hip joint of the user, or close thereto. Upon movement of the seat 2 upwardly or downwardly, the pivot axis 6 moves with the seat, so that the position of the pivot axis 6 with respect to the hip joint of the user down not change.

In accordance with a feature of the invention, a doublepivot lever 10' connects an extension 5' of the arm 5 with the support 1. This arrangement is so made that, upon movement of the chair back 4 towards the rear, the seat 2 will incline downwardly, thus giving the overall tilting effect illustrataed in FIG. 1 by comparing the full-line and chain-dotted line positions. The double-pivot 10' is connected by pivots 9 and 11, one at either end, to, respectively, the projecting portion 5' of the arm 5 and to the support 1, respectively.

The pivot 9 can be formed by a cross bolt extending transversely across the chair - in the drawing perpendicularly to the plane of the paper carrying FIG. 1. A spring element 7 which, preferably, is lockable and most desirably is a gas spring, is connected with one end by a pivot 8 to the support 1 and at its other with the arm 5 of the chair back 4. The spring element 7 can be of any desired type, for example operated mechanically, hydraulically or pneumatically, or a combination of all the foregoing modes. It is also possible, of course, to provide for a separate locking arrangement and a separate counterbalancing spring. If the pivot 9 is formed as a cross bolt extending transversely across the chair, the cross bolt 9 may also serve as the pivot to hold the spring element 7, which, as noted, preferably is a gas spring. The spring element 7 then can be located essentially centrally of the chair, for example in line with the center axis passing through the vertical portion of the support 1.

The drawing, and comparison of the full-line and chain-dotted positions, readily explains the operation. As can be seen, as the seat is tilted, the link 10' changes from the somewhat horizontal, inclined position shown in full lines to the essentially vertical position shown in broken lines with respect to the link 10'. It is to be noted that the double-link lever 10' carries out a movement in counter-clockwise direction, and the path of deflection of the spring 7 is a function of the tilt of the back; initially, starting from the full-line position, it is comparatively small. As the chair tilts back more and more, the spring deflection or spring path increases progressively. Consequently, the more a user leans back, the more counteracting force will be available, thus effectively counterbalancing the increasing shift of the weight of the user away from the center of the vertical portion of the support 1.

Figure 2:
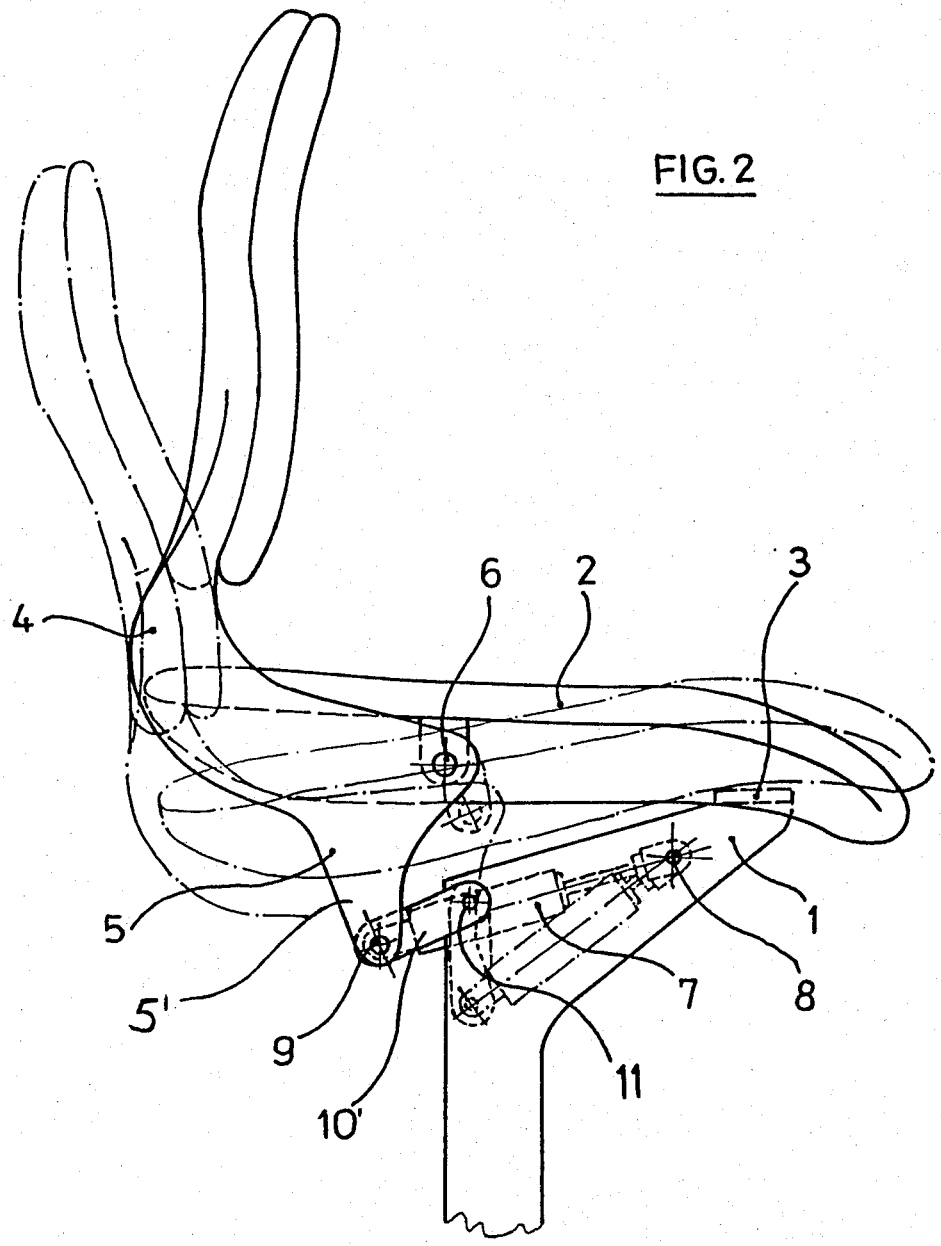

Embodiment of FIG. 2: The overall structure is similar to that of FIG. 1, and identical elements have been given identical reference numerals and need not be explained again. The basic difference is the way in which the attachment arm 5 is guided, that is, the specific construction of the guide means therefor. Rather than using the double-link lever 10', a guide track or guide curve 10 is provided to guide the arm 5 of the chair back 4. The guide curve 10 is formed by a slit 10 within the support 1 which, preferably, includes spaced frame members in which the slit 10 can be cut. The slit 10 has the identical function as the double-link lever 10', explained in connection with FIG. 1. The cross bolt 9, or equivalent pins, is positioned within the slit 10; the gas spring 7, again, can be secured to the cross bolt 9, or, if engaging stubs are used, merely engaging the slit 10, the spring 7 can be suitable attached to the arm 9 by attachment brackets or the like. The slit 10, preferably, is not entirely straight but slightly curved.

Various changes and modifications may be made within the scope of the inventive concept.

I claim:

1. Chair having a tilting seat and tilting back, especially tilting desk chair, including a support structure (1);

a seat (2) having a forward and a rear edge zone;

front connection means (3) pivotably connecting the forward edge zone of the seat to the support structure (1);

a chair back (4) having an upper portion and a lower portion;

an attachment arm (5) extending from the lower portion of the chair back (4) to a zone beneath the seat, and having two spaced pivot connection means (6, 9), a first pivot connection means (6) being located adjacent to or below the seat and positioned forwardly of a plane containing the upper portion of the chair back and pivotably connecting the attachment arm (5) and the seat (2), a second pivot connecting means (9) being located below the level of the seat and below said first connection means coupled to a guide means;

said guide means (10, 10') coupling the attachment arm (5) to the support structure (1) for changing the inclination of the chair back (4) with respect to the support structure, while simultaneously changing the position of the seat (2) with respect to the support structure (1);

lockable positioning-and-force means (7) attached to the support structure (1) and coupled to the arm (5) in the region of the second pivot connection means (9) and selectively providing a force on the seat (2) and on the chair back (4) to bias the back in an upright position, or permit locking of the seat and the chair back in a position of inclination selected by a user, and wherein the guide means (10, 10') is coupled to the attachment arm (5) and hence to the chair back (4) at a position spaced from said first pivot means (6), said guide means further being coupled to the support structure (1) for guiding the movement of the attachment arm (5) and hence relating, via said first pivot means (6), conjoint tilting movement of the seat (2) and of the chair back (4) as determined by the guide means, the attachment arm (5) forming a rigid connection between said first and said second spaced pivot connection means (6, 9) and providing a coupling between the chair back (4) and the seat (2) while permitting said conjoint tilting movement of the seat and of the chair back.

2. Chair according to claim 1, wherein (FIG. 2) the guide means comprises a guide track (10) on the support structure and a track follower coupled to the attachment arm (5).

3. Chair according to claim 2, wherein the guide track (10) comprises a slit (10) formed in the support structure (1);

and the track follower comprises a pin or bolt (9) positioned to move within said slit.

4. Chair according to claim 3, wherein said slit is curved.

5. Chair according to claim 3, wherein said track follower comprises a bolt (9) extending transversely across the chair, and movable in said slit.

6. Chair according to claim 5, wherein the positioning and force means (7) comprises an elongated structure having one end pivotably connected to the support structure (1) and a second end pivotably connected to said transverse bolt (9), and hence to the adjustable means (10').

7. Chair according to claim 2, wherein said guide track is curved.

8. Chair according to claim 2, wherein the first pivot connection means (6) comprises a pivot joint positioned just below the upper surface of the seat (2).

9. Chair according to claim 1, wherein the positioning and force means (7) is an elongated structure having one end coupled to the support structure (1), and a second end coupled to the adjustable means, the position of the respective ends being placed to increase the balancing force applied by the positioning and force means (7) as the deflection distance thereof increases upon tilting of the seat and the chair back from an essentially horizontal seatvertical back position to an inclined seat-backwardly tilted back position.

10. Chair according to claim 1, wherein said positioning and force means (7) comprises an elongated lockable spring element;

wherein said spring element has one end thereof pivotably connected to sid attachment arm (5) at said second pivot connection means (9);

and a second end of the spring element is pivotably connected (8) to the support structure (1).

11. Chair according to claim 1, wherein the guide means is movable.

12. Chair according to claim 11, wherein said guide means comprises a double-pivot lever (10') having one link pivot connected to the second pivot connection means (9) of the arm (5) extending from the chair back, and a second link pivot (11) connected to the support structure (1).

13. Chair according to claim 12, wherein said second pivot connection means (9) coupled to said one link pivot comprises a bolt (9) extending transversely across the chair.

14. Chair according to claim 13, wherein the positioning and force means (7) comprises an elongated structure having one end pivotably connected to the support structure (1) and a second end pivotably connected to said transverse bolt (9), and hence to the adjustable means (10).

15. Chair according to claim 14, wherein said positioning and force means (7) comprises a lockable spring element.

16. Chair according to claim 12, wherein the positioning and force means (7) comprises an elongated structure having a fist end pivotably connected to said support structure (1) and a second end pivotably connected to said attachment arm (5) at said second pivot connection means and at a position at least approximately in-line with said one link pivot;

and the position of the pivotable attachment of said one end of the positioning and force means (7) to the support structure (1) is so selected that, when the seat is in an essentially horizontal position and the back is in an essentially vertical or forward position, said one link pivot and said second link pivot (11) of the double-pivot element (10') as well as the first and second ends of the positioning and force means (7) are essentially located in a line or a horizontal projection of said line.

17. Chair according to claim 12, wherein said positioning and force means (7) comprises a lockable spring element (7).

18. Chair according to claim 17, wherein said spring element has one end thereof pivotably connected to said attachment arm (5) at said second pivot connection means (9);

and a second end of the spring element is pivotably connected (8) to the support structure (1).

19. Chair according to claim 12, wherein said positioning and force means (7) comprises a lockable gas spring.

20. Chair according to claim 19, wherein said gas spring has one end thereof pivotably connected to said attachment arm (5) at said second pivot connection means (9);

and a second end of the gas spring is pivotably connected (8) to the support structure (1).

21. Chair according to claim 12, wherein the first pivot connection means (6) comprises a pivot joint positioned just below the upper surface of the seat (2).

* * * * *